United States Patent [19]

Lassota

BEST AVAILABLE COPY

[11] 4,010,675

[45] Mar. 8, 1977

[54] TWO STROKE MECHANISM WITH ROTARY PISTON AND CYLINDER-PISTON MOVEMENT

[76] Inventor: Marek J. Lassota, 4132 W. Roscoe St., Chicago, Ill. 60641

[22] Filed: Sept. 4, 1975

[21] Appl. No.: 610,159

Related U.S. Application Data

[63] Continuation of Ser. No. 523,958, Nov. 14, 1974, abandoned, which is a continuation-in-part of Ser. No. 506,613, Sept. 16, 1974, abandoned, which is a continuation-in-part of Ser. No. 425,507, Dec. 17, 1973, abandoned, which is a continuation-in-part of Ser. No. 361,472, May 18, 1973, abandoned, which is a continuation-in-part of Ser. No. 221,198, Jan. 27, 1972, abandoned.

[52] U.S. Cl. ..... 92/54; 60/39.6; 123/1 R; 123/42; 123/43 R; 123/45 R; 123/50 R; 92/117 R; 417/464; 418/54

[51] Int. Cl.[2] ..... F02B 59/00

[58] Field of Search ..... 123/1, 42 R, 45 R, 50 R, 123/50 A, 50 B, 18 R, 18 A, 43 R; 91/796, 196, 176, 210; 92/54, 118, 119, 117 R, 117 A; 417/464; 418/52, 53, 68, 54; 60/39.6

[56] References Cited

UNITED STATES PATENTS

| | | | |
|---|---|---|---|
| 39,957 | 9/1863 | Root | 92/177 |
| 632,010 | 8/1899 | Gamble | 91/196 |
| 1,067,705 | 7/1913 | Zellar | 92/177 |
| 1,598,653 | 9/1926 | Peters | 92/177 X |
| 1,718,070 | 6/1929 | Peters | 92/177 X |
| 3,090,366 | 5/1963 | Nagelmann | 123/42 |
| 3,315,653 | 4/1967 | Chicurel | 123/51 B |
| 3,692,005 | 9/1972 | Buske | 123/51 R |
| 3,835,823 | 9/1974 | Miller | 123/42 |

FOREIGN PATENTS OR APPLICATIONS

| | | | |
|---|---|---|---|
| 740,703 | 10/1943 | Germany | 123/42 |

*Primary Examiner*—Wendell E. Burns

[57] ABSTRACT

A two stroke mechanism is described which has rotary moveable piston and cylinder-piston elements. The piston and cylinder-piston elements both rotate within a stationary body forming two variable volume chambers. The first variable volume chamber formed between the piston and cylinder-piston elements may serve as a combustion or compression chamber. The second variable volume chamber formed around the piston and cylinder-piston elements and within the stationary body may serve as a precompression chamber. Methods for balancing, sealing, intake, discharge and cooling such mechanisms are disclosed. The mechanisms are especially useful as internal combustion primer movers, external combustion prime movers, pumps and compressors.

42 Claims, 15 Drawing Figures

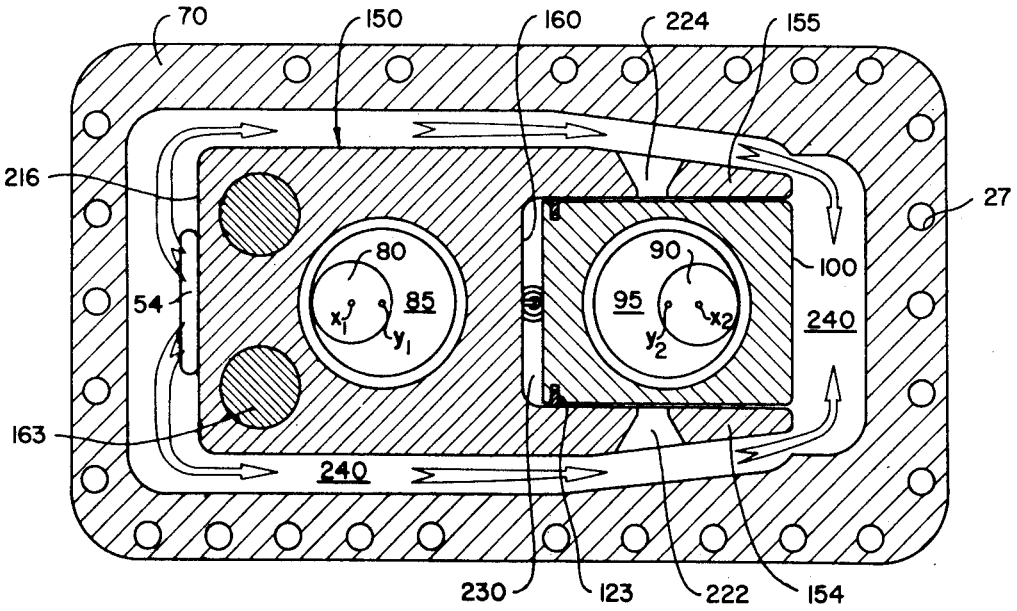
FIGURE 12
FIGURE 13
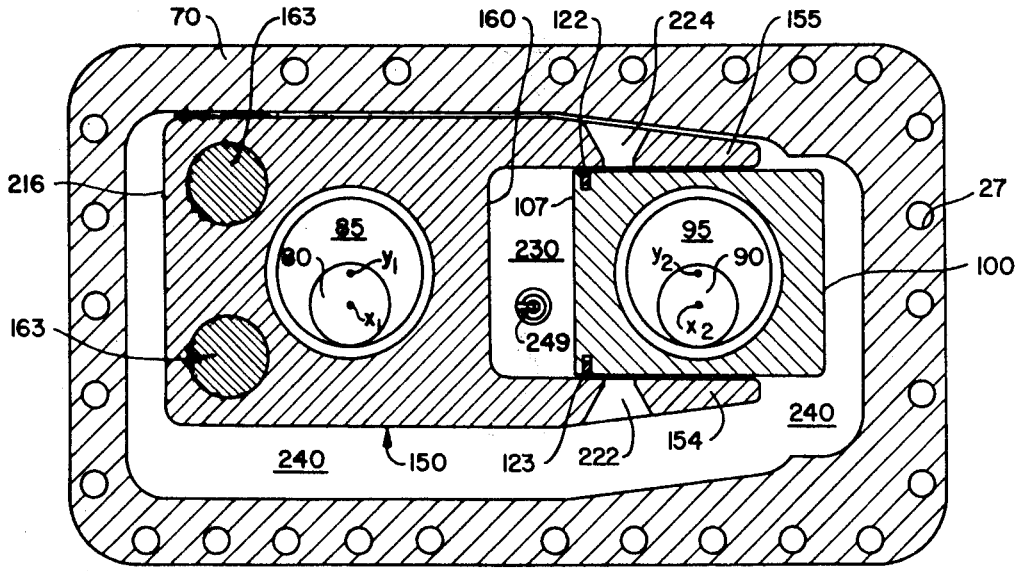

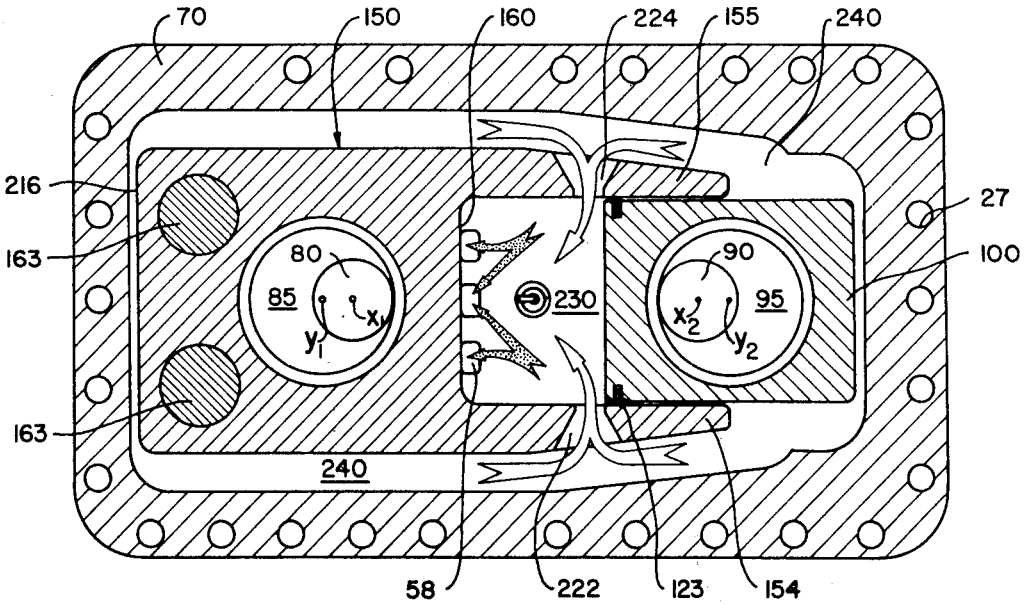
FIGURE 14
FIGURE 15
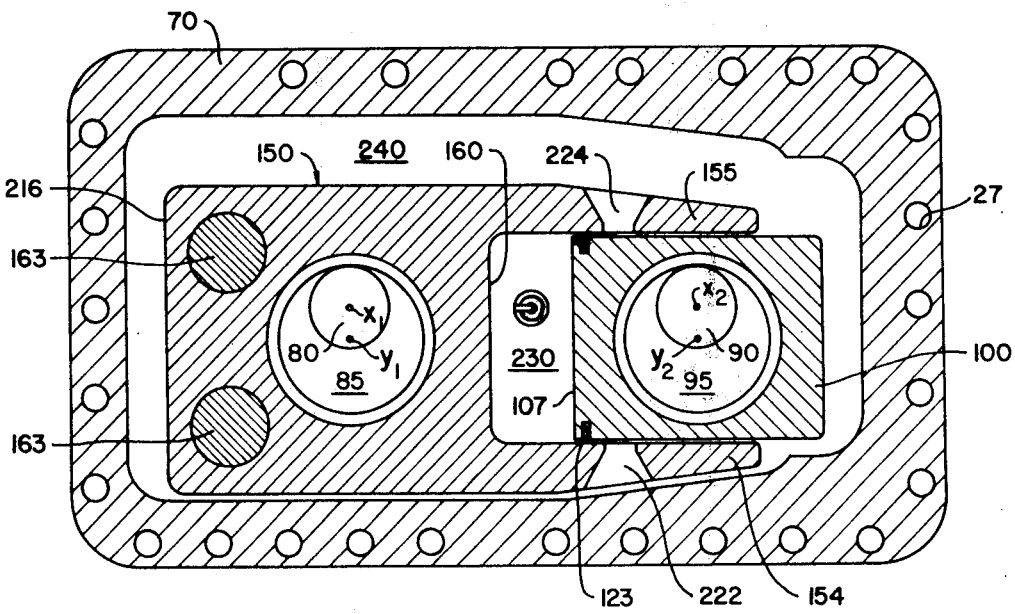

TWO STROKE MECHANISM WITH ROTARY PISTON AND CYLINDER-PISTON MOVEMENT

CROSS REFERENCE TO RELATED APPLICATIONS

This is a continuation of application Ser. No. 523,958, filed Nov. 14, 1974, now abandoned which is a continuation-in-part of my co-pending application Ser. No. 506,613 filed Sept. 16, 1974, which is a continuation-in-part of Ser. No. 425,507 filed Dec. 17, 1973, which is a continuation-in-part of Ser. No. 361,472 filed May 18, 1973, which is a continuation-in-part of Ser. No. 221,198 filed Jan. 27, 1972 all now abandoned.

There have been various efforts to depart from the conventional engines having reciprocating pistons and stationary cylinders which present difficulties in obtaining good balancing. One approach which has been taken is to develop various types of rotary engines such as the various Wankel engines. The rotary engines of the prior art have presented serious disadvantages in obtaining satisfactory sealing between the coworking elements since they have curvilinear surfaces in contact with sealing elements. Representative generally of rotary engines are prior art patents such as U.S. Pat. Nos. 3,033,180; 3,189,263; and 3,246,636. In some rotary engine designs as shown in U.S. Pat. Nos. 3,550,565 and 3,499,429, use of any sealing elements is excluded by the design. Further, many designs of rotary engines have large surface to volume ratios of the combustion chambers leading to lower thermal efficiencies, leading, in turn, to lower overall efficiencies and higher fuel consumptions than reciprocating engines.

The invention described in the present application generally relates to a rotary mechanism such as internal combustion engines, external combustion engines, steam expanders, fluid motors, pumps and compressors. Particularly, this invention is directed to a two stroke internal combustion rotary engine and for convenience will be described in connection with a two stroke, Otto cycle internal combustion rotary engine. However, as it will become apparent, the invention is equally applicable to other forms of rotary machines such as Diesel cycle internal combustion engine, external combustion engines, steam engines or steam expanders, pumps, compressors and other fluid motors. General structure of the engine, balancing system and sealing arrangement of the combustion chamber are also applicable for the four stroke version of the rotary mechanism disclosed herein.

The internal combustion two stroke rotary engine of this invention, comprises generally an outer stationary body and inner rotatably mounted piston and cylinder-piston elements with their eccentric shafts, gearing and balancing means. The outer stationary body has two opposed spaced stationary chamber flat walls interconnected by a peripheral wall to form a main cavity in which the piston and cylinder-piston operate. Said piston and cylinder-piston elements are rotatably mounted on their eccentric shafts within said cavity and are forming together with said stationary chamber flat walls and said peripheral wall two variable volume chambers, varying in volumes during the operation of the engine. One variable volume working chamber, or combustion chamber is located between piston and cylinder-piston elements and between said stationary chamber flat walls; the second variable volume crankcase chamber, or precompression chamber is formed around the piston and cylinder-piston elements and within the above defined main cavity. Furthermore, said eccentric shafts have a gearing means interconnecting them and coordinating their rotary movements in such a way so said eccentric shafts follow opposite and coordinated rotary movements. Journaled on the eccentric at one of the eccentric shafts is the piston element and on the eccentric at the other eccentric shaft is cylinder-piston element, which elements follow opposite and coordinated planetary rotary movements. Furthermore, said stationary, flat chamber walls have intake and exhaust channels and ports, and said cylinder-piston element has also intake or transfer ports. Said intake and exhaust ports are being sequentially opened and closed during the operation of the engine to effect a two stroke, or two cycle operation of the internal combustion rotary engine. As it will be described in full detail, the said two stroke cycle of operation is achieved by relative planetary rotations, coordinated and in the opposite directions, of the piston and cylinder-piston elements between the stationary, flat chamber walls and within the above described main cavity, with piston and cylinder-piston elements sequentially opening and closing said intake and exhaust ports to effect required flow of fresh air-fuel charge and spent products of combustion respectively in required intervals.

For efficient operation an internal combustion two stroke, rotary engine must be provided with a precompression chamber to partly compress incoming air-fuel to air charge before said charge will be transferred into the combustion chamber. The ratio of the maximum volume to the minimum volume of the said precompression chamber must be as high as possible in order to allow for highest possible precompression of the fresh incoming charge. Furthermore, said internal combustion rotary engine must have intake and exhaust channels and ports of suitable dimensions and shapes and arranged in a manner as to provide minimum restriction for the flowing gases and maximum volumetric efficiency.

Therefore, one object of the present invention is to provide a two stroke mechanism being simple in construction, having relatively few parts, efficient in operation, compact, lightweight, well balanced and vibrationless, suitable for operation as an internal or external combustion prime mover or pump or compressor.

Yet another object of the present invention is an internal combustion two stroke rotary engine with an intake and exhaust channels and ports having large enough areas for flow of fresh charge and spent products of combustion with minimum restrictions.

Another object of the present invention is to provide an internal combustion two stroke rotary engine having high volumetric efficiency and high overall efficiency.

Another object of the present invention is to provide an internal combustion two stroke naturally aspirated rotary engine having a precompression chamber with high ratio of the maximum volume to the minimum volume and providing high precompression of the fresh, incoming charge.

Another object of the present invention will become apparent when reading the annexed detailed description in the view of the drawings, which will now be presented.

FIG. 12 is a transverse sectional view taken along the line A—A in FIG. 1 and shows the internal combustion two stroke rotary engine at the end of the compression stroke and at the beginning of the power stroke in the combustion chamber.

FIG. 13 is a transverse sectional view taken along the line A—A in FIG. 1 and shows the two stroke internal combustion rotary engine in the middle of the power stroke.

FIG. 14 is a transverse sectional view taken along the line A—A in FIG. 1 and shows the internal combustion rotary two stroke engine in the middle of the exhaust and intake portions of the stroke.

FIG. 15 is a transverse sectional view taken along the line A—A in FIG. 1 and shows the internal combustion two stroke rotary engine in the middle of the compression stroke in the combustion chamber.

Figure 1:
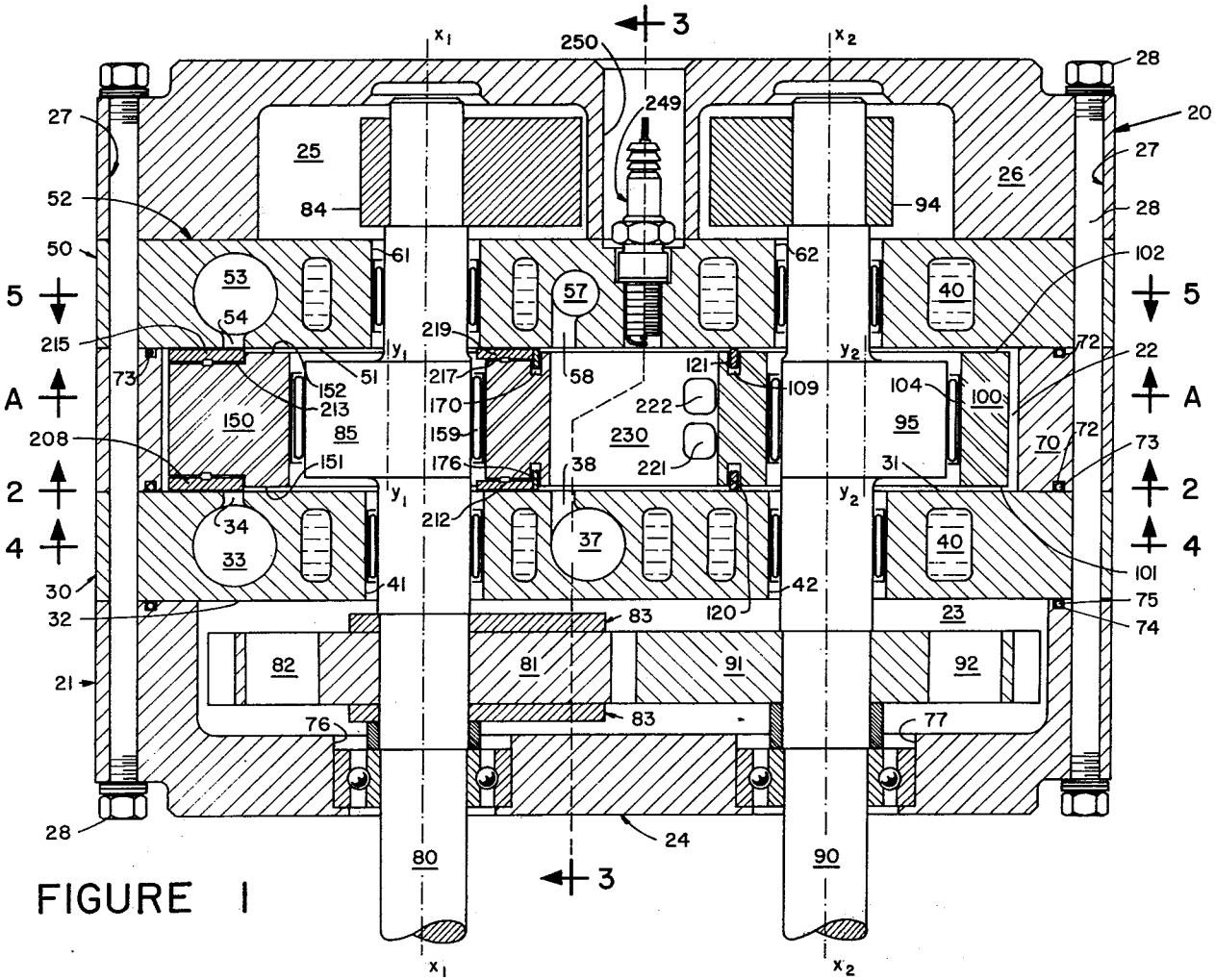
FIG. 1 is a longitudinal sectional view through a rotary internal combustion two stroke engine embodying this invention along the line 1—1 in FIG. 2.
Figure 2:
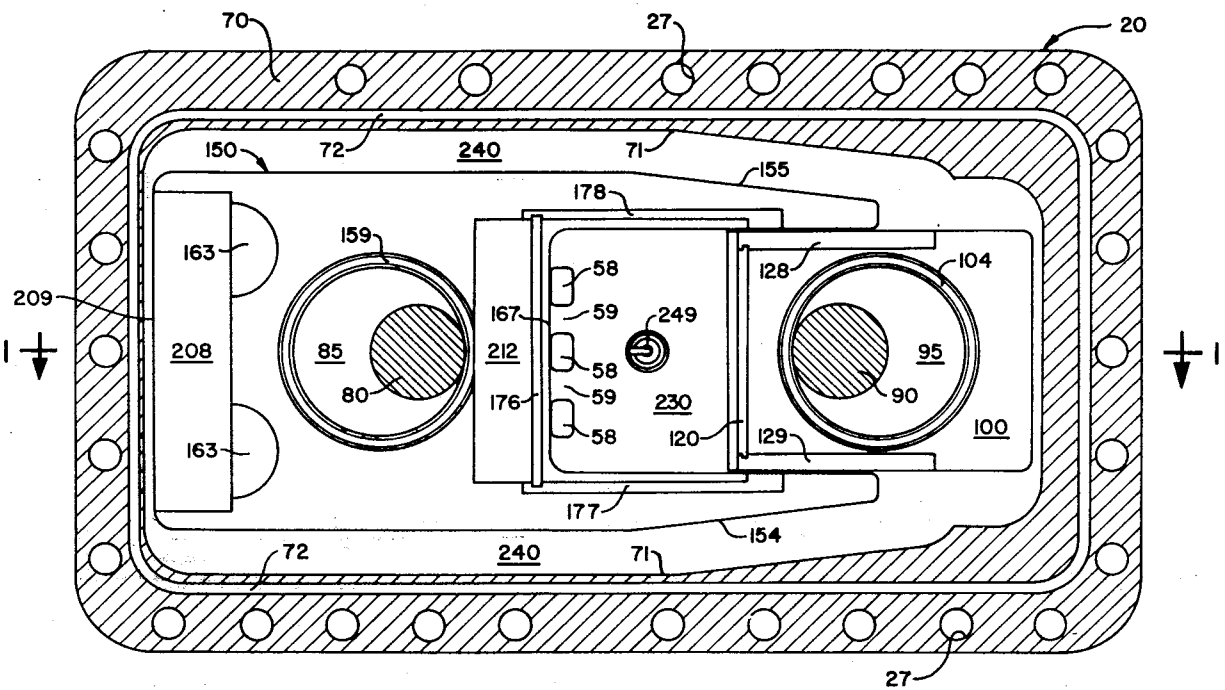
FIG. 2 is a transverse sectional view taken along the line 2—2 of FIG. 1, showing the piston and cylinder-piston elements positioned within their housing.
Figure 3:
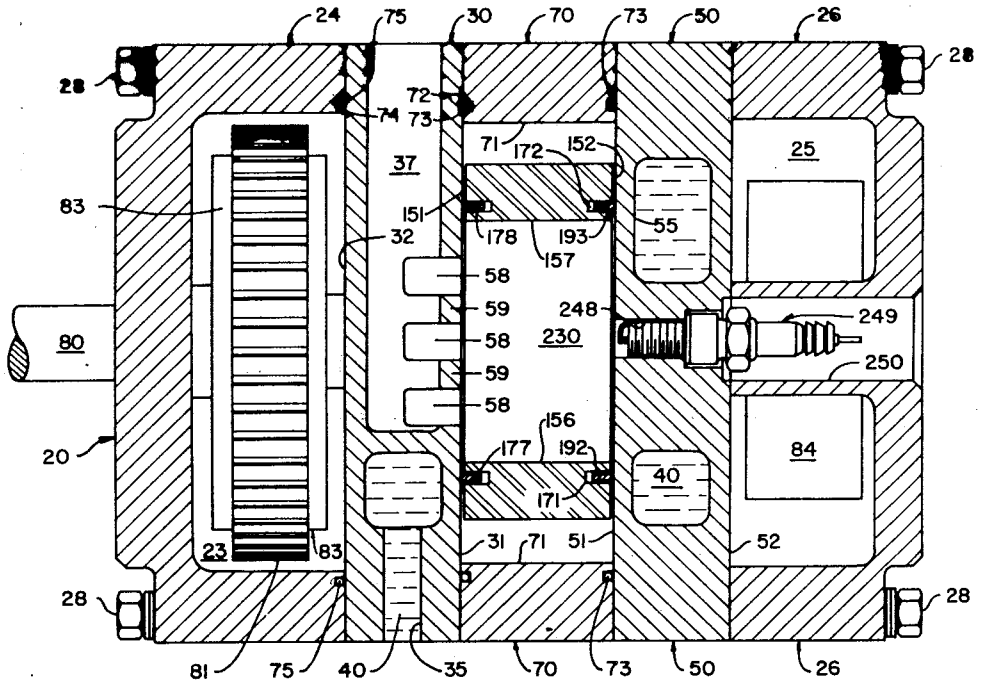
FIG. 3 is a vertical sectional view, taken along the broken line 3—3 of FIG. 1

Referring first to the FIGS. 1, 2 and 3 of the drawings, an internal combustion two stroke, rotary engine is shown as 20. The two stroke rotary engine comprises an engine body, generally shown as 21. Body 21 has a main cavity 22, within which piston 100 and cylinder-piston 150 elements are received, said piston 100 and cylinder-piston 150 elements being rotatable in opposed rotary motions and forming movable walls of a first variable volume chamber, or combustion chamber 230 and a second variable volume chamber, or precompression chamber 240. The main cavity 22 is formed by the stationary, flat chamber walls axially spaced and shown as front wall 30 and back wall 50 and by interconnecting them with peripheral wall 70. The stationary chamber front wall 30 has one flat side 31 and second 32. Stationary flat chamber back wall 50 has also one flat side 51 and second side 52. Flat sides 31 and 51 of the stationary chamber flat walls 30 and 50 define the stationary surfaces of variable volume combustion chamber 230. Likewise, flat sides 31 and 51 of stationary chamber walls 30 and 50 together with inside surface 71 of peripheral wall 70 define the stationary surfaces of precompression chamber 240. Chamber 240 is located around piston 100 and cylinder-piston 150 and within main cavity 22. Furthermore, engine body 21 has gear transmission cavity 23 formed by the gear transmission cover 24 and a counterbalance cavity 25 formed by the counterbalances cover 26.

All said elements 24, 26, 30, 50 and 70 of the said rotary two stroke engine's body 21 may have a substantially rectangular shape, or profile, with rounded corners which is in a plane normal to the axes $x_1$—$x_1$ and $x_2$—$x_2$ of the two eccentric shafts, cylinder-piston eccentric shaft 80 and piston eccentric shaft 90, respectively. All said elements 24, 26, 30, 50 and 70 of the body 21 have furthermore a plurality of openings, shown generally as 27, which are parallel to the axes $x_1$—$x_1$ and $x_2$—$x_2$ of the eccentric shafts 80 and 90. Openings 27 in the elements of the said engine body 21 receive bolts 28 firmly securing together all elements 24, 26, 30, 50 and 70 of the body 20. Openings 27 with bolts 28 are spaced so as not to interfere with intake channels 33 and 53 and exhaust channels 37 and 57 or with the connections of the cooling system, as it will be later described.

Figure 4:
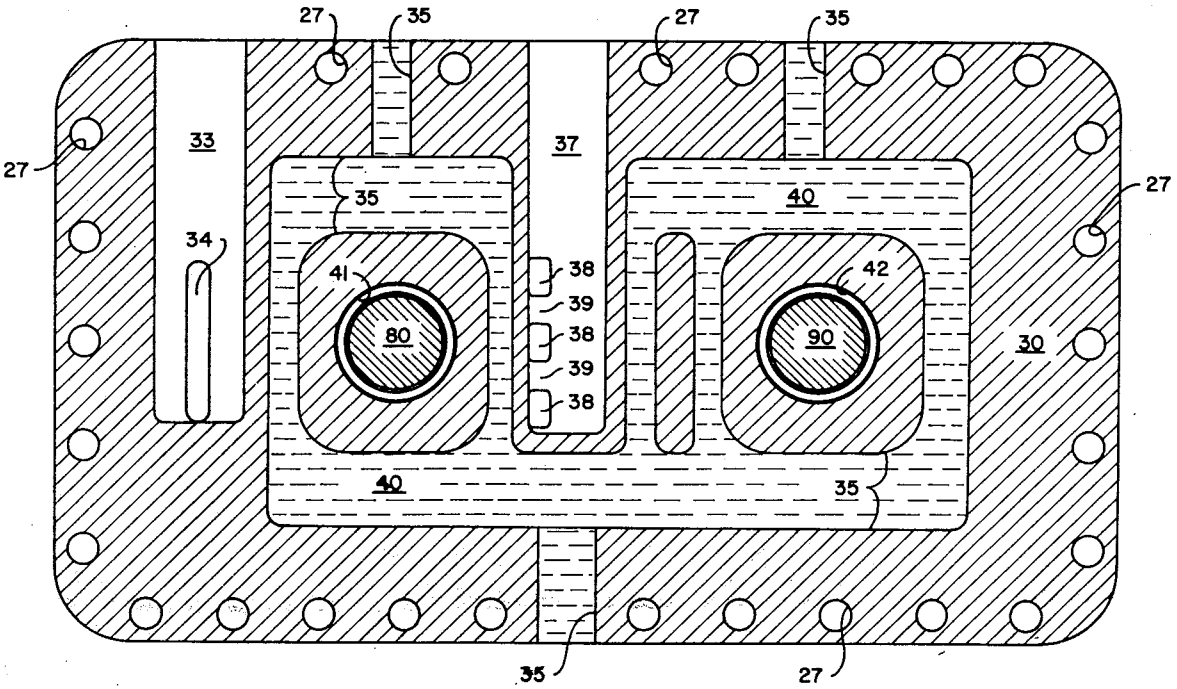
FIG. 4 is a transverse sectional view, taken along the line 4—4 in the view of FIG. 1, showing the internal structures of the front stationary flat chamber wall with the intake and exhaust channels and ports also being shown.
Figure 5:
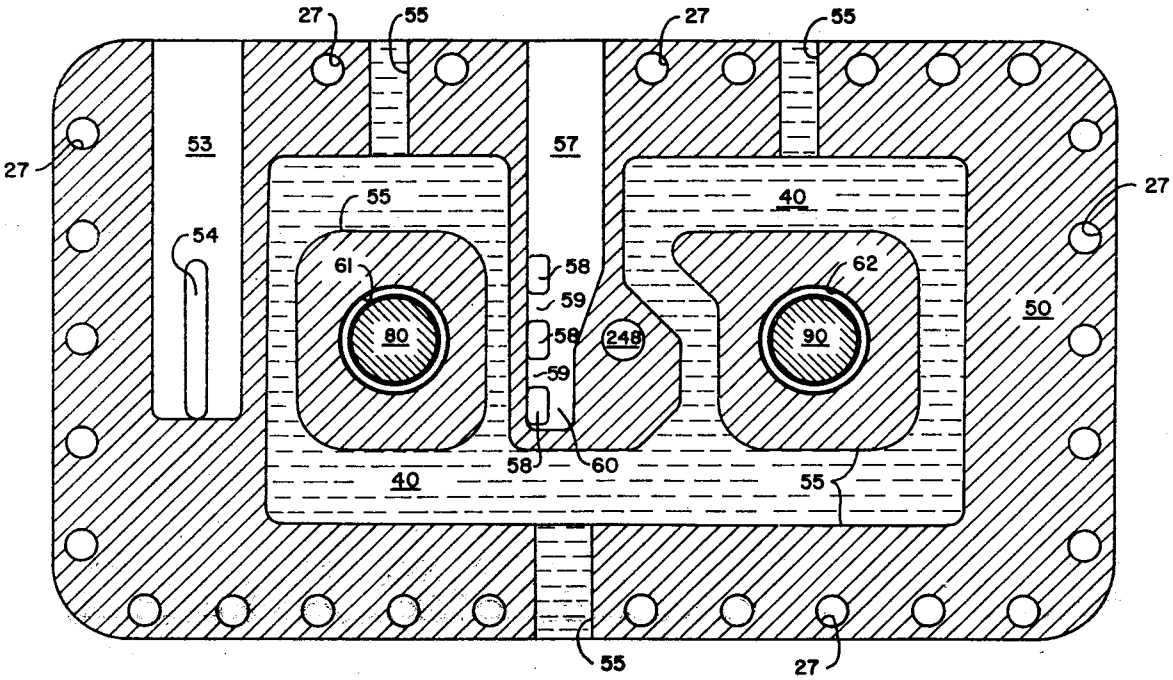
FIG. 5 is a transverse sectional view taken along the line 5—5 of FIG. 1 and showing the internal structures of the back stationary flat chamber wall with intake and exhaust channels and ports and spark plug opening being shown.

To complete the detailed description of the elements of the engine's body 21, internal structures of said elements will be described in full details. The internal structures of stationary, flat chamber walls 30 and 50 are best shown in the view of the FIGS. 4 and 5. Stationary chamber front wall 30 has intake channel 33 located on the side of wall 30. Intake channel 33 is connected with the precompression chamber 240 by intake port 34. Port 34 is located alongside one end of channel 33 and parallel to edge 209 of sealing element 208 of cylinder-piston 150. Intake port 34 is sequentially opened and closed by edge 209 of sealing element 208 of cylinder-piston element 150 during the operation of the internal combustion two stroke rotary engine. Stationary chamber flat front wall 30 also includes exhaust channel 37, located in the central portion of wall 30. Exhaust channel 37 is connected with combustion chamber 230 by exhaust ports 38, exhaust ports 38 being parallel to edge 167 of wall 160 of cylinder-piston 150. The exhaust ports are opened and closed by edge 167 of cylinder-piston element 150 during the operation of the engine. Exhaust ports 38 are further separated by bridges 39, bridges 39 providing guidance for the sealing strip 176 of the cylinder-piston element 150 as it passes exhaust ports 38.

Stationary chamber back wall 50 also includes an intake channel 53 with its intake port 54 connecting one end of intake channel 53 with precompression chamber 240 during the intake of fresh charge from intake channel 53 into said precompression chamber 240. Intake channel 53 with its intake port 54 are further located in the stationary chamber wall 50 in a similar position as is intake channel 33 and intake port 34 in the front stationary chamber wall 30. Furthermore, said stationary back chamber wall 50 includes an exhaust chamber 57 with its exhaust ports 58 connecting said exhaust channel 57 with a combustion chamber 230. Furthermore, said exhaust ports 58 are separated by a bridges 59 providing guidance for sealing strip 191 of cylinder-piston element 150 as the sealing strip 191 passes over exhaust ports while rotating in planetary rotation with said cylinder-piston element 150. Exhaust channel 57 is shaped in its bottom portion 60 to provide for opening 248 for spark plug 249.

Said stationary front chamber wall 30 also includes two passageways 41 and 42, and the stationary back chamber wall 50 includes similar passageways 61 and 62. The pair of openings 41 and 61 have common axis $x_1$—$x_1$ being also the axis of the cylinder-piston eccentric shaft 80. The pair of passageways 42 and 62 and has an axis $x_2$—$x_2$ common with a piston eccentric shaft 90. The axes $x_1$—$x_1$ and $x_2$—$x_2$ of the eccentric shafts 80 and 90 are located in a common plane, normal to elements 24, 26, 30, 50 and 70 of engine body 21 and are normal to these elements. The axes $x_1$—$x_1$ and $x_2$—$x_2$ are spaced for meshing two gears 81 and 91.

Stationary chamber front wall 30 has internal cooling chamber 35 and back wall 50 has internal cooling chamber 55. Fluid 40 circulates in these chambers. Coolant chambers 35 and 55 are connected to a cooling mean (not shown) for cooling fluid 40. The cooling means may be a radiator or any other heat exchanger suitable for cooling fluid 40.

Stationary walls of combustion chamber 230 are interconnected by peripheral wall 70 which axially spaces sides 31 and 51 of walls 30 and 50, respectively, so that flat sides 31 and 51 are parallel and axially spaced as required for the operation of piston 100 and cylinder-piston 150. Peripheral wall 70 has means for sealing between wall 70 and flat sides 31 and 51. The figures show grooves 72, located in the sides of wall 70 communicating with flat sides 31 and 51 of the stationary chamber flat walls 30 and 50. Rubber O-rings 73 are located in grooves 72 to provide sealing of the precompression chamber 240. Groove 74 is located in gear transmission cover 24 and rubber O-ring 75 is in groove 74, sealing the gear transmission cavity 23, preventing oil leakage from the cavity. Gear transmission cover 24 further includes two passageways 76 and 77 located in a similar manner as passageways 41 and 61 and 42 and 62, respectively. Stationary back counter-balances cover 26 has opening 250, corresponding with opening 248 of the back stationary chamber wall 50. Opening 250 is provided for the purpose of inserting the spark plug 249 in position with minimum difficulty.

Figure 6:
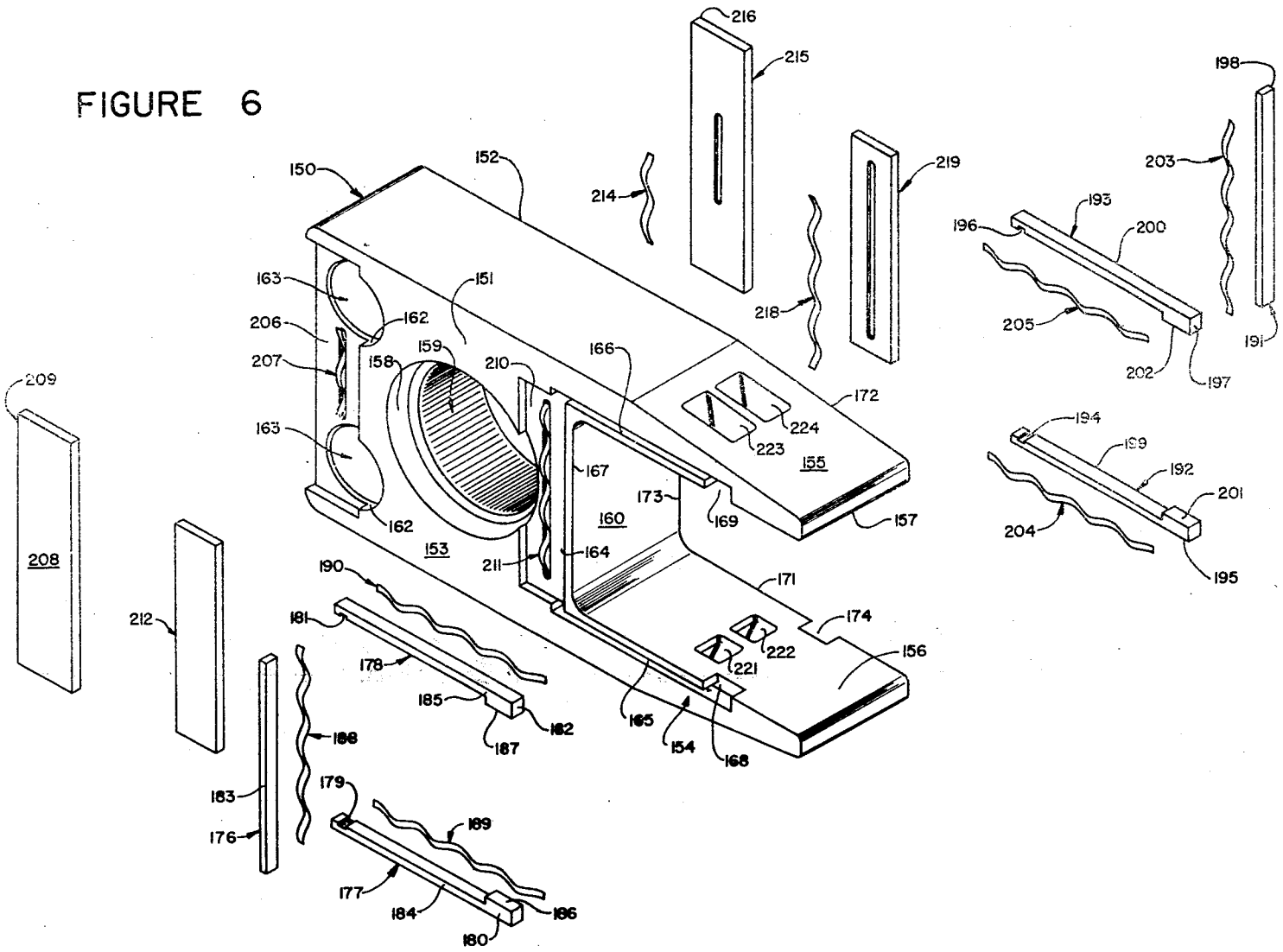
FIG. 6 is a perspective view of the cylinder-piston element with the sealing elements and springs being exploded.

FIG. 6 shows, in a perspective view, cylinder-piston element 150 with its sealing elements and springs exploded. Cylinder-piston 150 have opposing flat sides 151 and 152. The cylinder-piston element is a U-shaped body 150 and includes a polyhedral type body 153 and spaced, parallel arms 154 and 155 having opposing parallel flat walls 156 and 157.

The term cylinder-piston element refers to generally U-shaped element or body, operating as both a piston and a cylinder, although the configuration is not at all geometrically cylindrical.

The cylinder-piston element has a passageway 158 in which is mounted bearing 159. Bearing 159 is rotatably assembled on eccentric 85 of eccentric shaft 80. Wall 160 of polyhedral body 153 joins walls 156 and 157. Walls 156, 157 and 160 are three of four movable walls of combustion chamber 230. At the end of polyhedral body 153 opposite from parallel arms 154 and 155 are two or more openings 162. Openings 162 are a housing for balancing elements 163. The purpose of the cylinder-piston balancing elements 163 is to balance the masses forming the spaced, parallel arms 154 and 155 and their sealing elements in such a manner as to make the center of gravity of cylinder-piston element 150 located on or close to the axis $y_1$–$y_1$, which is common for bearing 159 and eccentric 85 of the eccentric shaft 80.

Cylinder-piston element 150 includes on each side surfaces 151 and 152 three grooves, located alongside the edges of the walls 160, 156 and 157. The grooves, having substantially rectangular shape in cross section, are also shown in the views of FIGS. 1 and 3. The grooves, located on side 151 are numbered 164, 165 and 166. Groove 164 is located alongside edge 167 of the wall 160, and grooves 165 and 166 are located alongside the edges of flat walls 156 and 157, respectively. Grooves 165 and 166 have in the ends outwardly from wall 160 apertures 168 and 169, respectively. The apertures form openings between grooves 165 and 166 and the space located between spaced, parallel walls 156 and 157. The grooves, located on side 152 are numbered 170 for groove located alongside edge 173 of the wall 160, and 171 and 172 for grooves located alongside the edges of flat walls 156 and 157, respectively. Grooves 171 and 172 have in the ends outwardly from wall 160 apertures 174 and 175, respectively. These apertures form openings between grooves 171 and 172 and the space located between spaced, parallel walls 156 and 157.

FIG. 6 also shows the sealing elements of combustion chamber 230, located in the grooves of cylinder-piston 150. Sealing element, which will be located in the groove 164 on the side 151 is shown as 176. Sealing strips, which will be located in grooves 165 and 166 are numbered 177 and 178, respectively. Sealing element 176 is a simple elongated strip. Element 177 has groove 179 in one end and flange 180 at the second end. Also, element 178 has corresponding groove 181 in the one end and flange 182 at second end. Strip-waved springs 188, 189 and 190 will be located in grooves 164, 165 and 166, respectively, and will push sealing elements 176, 177 and 178 against flat side 31 of the front stationary wall 30.

Sealing element, which will be located in groove 170 on side 152 of cylinder-piston 150 is numbered 191. Sealing strips, which will be located in grooves 171 and 172 are numbered 192 and 193, respectively. Sealing element 191 is simple elongated strip. Element 192 has groove 194 in one end, and flange portion 195 in opposite end. Also, element 193 has groove 196 in one end and flange portion 197 in the opposite end. Strip-waves springs 203, 204 and 205 will be located in grooves 170, 171 and 172, respectively, and will force sealing elements 191, 192 and 193 against flat side 51 of the back stationary wall 50.

On side 151 cylinder-piston 150 has a recess 206, in which plate 208 sealing intake port 34 is received. Plate 208 is forced against flat side 31 by means of a spring 207. Edge 209 of plate 208 is sequentially opening and closing intake port 34 during the operation of the engine. In second recess 210, located in side 151, plate 212 is received. Plate 212 is pushed against flat side 31 by spring 211 and said plate 212 sequentially seals exhaust ports 38 for the required time during the operation of the engine.

In a similar manner two recesses 213 and 217 are located in side 152 of cylinder-piston 150. Plates 215 and 219, with their springs 214 and 218, are located in recesses 213 and 217, respectively. Plate 215 seals intake port 54, and its edge 216 opens and closes said intake port 54 during the operation of the engine. Plate 219 seals exhaust ports 58 in a manner similar to plate 212.

Cylinder-piston 150 also includes transfer ports connecting precompression chamber 240 with combustion chamber 230 during the intake portion of the stroke. Two transfer ports 221 and 222 are located in arm 154, and two transfer ports 223 and 224 are located in arm 155 of cylinder-piston 150. These ports are sequentially opened and closed during the operation of the engine by piston element 100.

Figure 7:
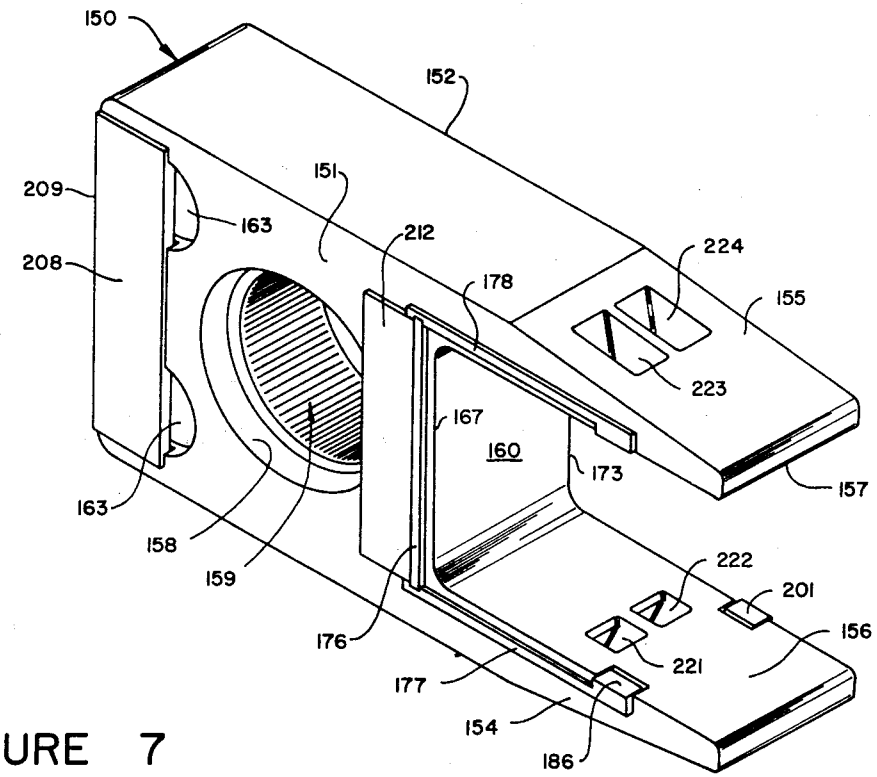
FIG. 7 is a perspective view of the cylinder-piston element with all sealing elements in place.

FIG. 7 shows, in a perspective view, cylinder-piston 150 with its sealing elements inserted in their places. Surfaces 186 and 201 of flanges 180 and 195 are in the same plane as surface 156, and surfaces 187 and 202 of flange portions 182 and 197 are in the same plane as surface 157. Ends of strip 176 are in their grooves 179 and 181, and (visible in the view of FIG. 11) ends of strip 191 are in their grooves 194 and 196. Thus, sealing elements 177, 176 and 178 form on side 151 continuous path leading from the surface 156, through flange 180 and seal 177 interconnected at groove 179 with seal 176, through seal 176 interconnected at groove 181 with seal 178, through seal 178 and its flange portion 182 to the surface 157. Similar sealing path is formed by seals 192, 191 and 193 on opposite side 152 of cylinder-piston element 150, and the above description applies.

Figure 8:
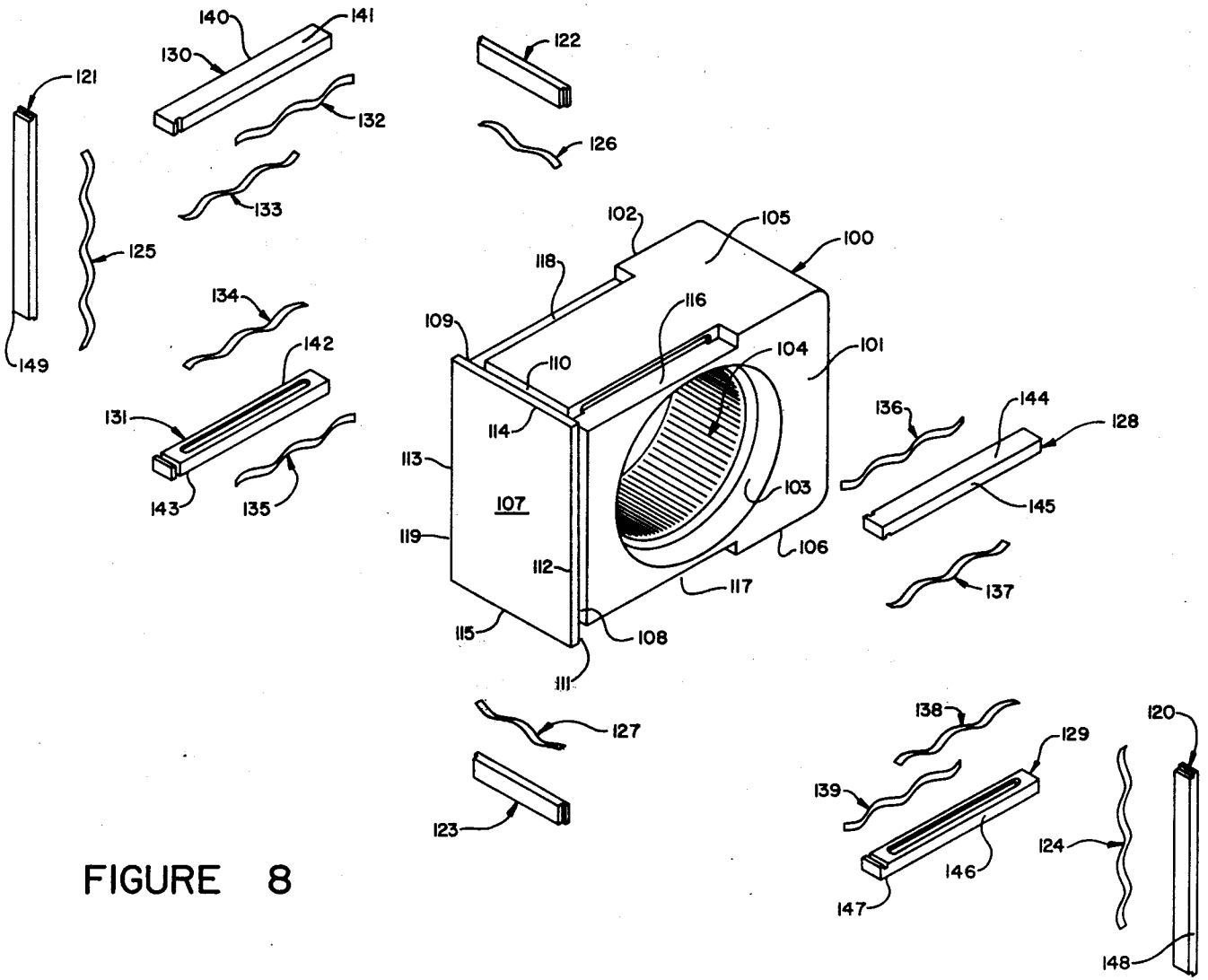
FIG. 8 is a perspective view of the piston element with the sealing elements and springs being exploded.

FIG. 8 shows, in a perspective view, polyhedral piston element 100 with its sealing elements and springs exploded. Piston 100 has opposed flat sides 101 and 102, interconnected by passageway 103 in which bearing 104 is mounted. Bearing 104 is rotatably assembled on eccentric 95 of eccentric shaft 90. Piston 100 has also pair of parallel, flat sides 105 and 106, adjacent to flat walls 157 and 156 of cylinder-piston 150, respectively, after assembly of the engine. Wall 107 joins sides 101 and 102 and sides 105 and 106. Furthermore, wall 107 forms fourth of the movable walls of the combustion chamber 230 and is changing the volume of the combustion chamber 230 during the operation of the engine.

In its side surfaces 101, 102, 105 and 106, piston element 100 includes grooves 108, 109, 110 and 111, respectively. Grooves 108, 109, 110 and 111 are substantially rectangular in cross section and are located alongside edges 112, 113, 114 and 115 of wall 107. Piston 100 also includes grooves, or steps 116, 117, 118 and 119 located alongside corners between sides 101 and 102 and sides 105 and 106.

FIG. 8 also shows elements sealing combustion chamber 230. Elements 120, 121, 122 and 123 will be located in grooves 108, 109, 110 and 111, respectively. Springs 124 and 125 will force sealing elements 120 and 121 against co-working flat surfaces 31 and 51 of stationary walls 30 and 50. Springs 126 and 127 will force sealing elements 122 and 123 against co-working flat surfaces 157 and 156 of cylinder-piston 150, respectively.

Sealing elements 128, 129, 130 and 131 will be located in grooves 116, 117, 118 and 119, respectively. Sealing strips 120, 121, 122 and 123 have steps in their ends. Sealing elements 128, 129, 130 and 131 have grooves in ends close to wall 107 of piston element 100. Steps in ends of sealing strips 120, 121, 122 and 123 are interconnected, after assembly, in grooves in elements 128, 129, 130 and 131 to form closed sealing path around piston element 100.

Sealing elements 128, 129, 130 and 131 are pushed, when fully assembled, by their springs 136, 139, 132 and 135 against flat surfaces 31 and 51 of stationary walls 30 and 50, and by springs 138, 134, 137 and 133 against flat surfaces 156 and 157 of cylinder-piston element 150. Thus, sealing elements 128, 129, 130 and 131 seal the corners of combustion chamber 230, said corner formed between flat surfaces 31, 51, 156 and 157.

Figure 9:
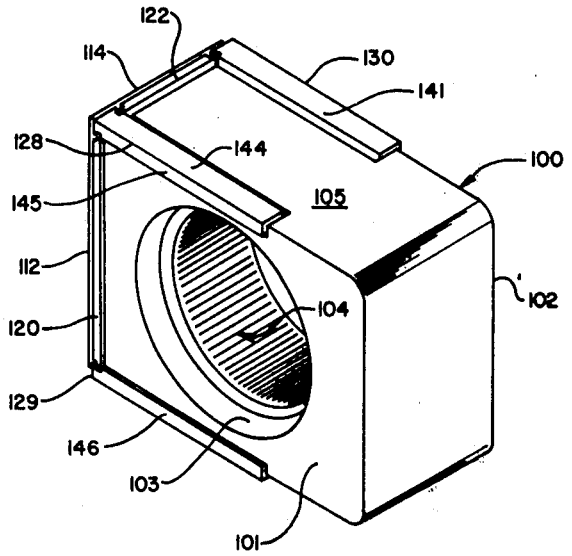
FIG. 9 is a perspective view of the piston element with all sealing elements in place.

FIG. 9 shows, in a perspective view, piston 100 assembled with its sealing elements inserted in their grooves. When piston 100 is fully inserted between flat walls 156 and 157, and flat walls 31 and 51, elements 120, 121, 122 and 123 will have their ends fully inserted in grooves in elements 128, 129, 130 and 131 and continuous sealing path around piston 100 will be formed.

Furthermore, piston element 100 with all its sealing elements and their springs inserted has its center of gravity located on or close to axis $y_2$–$y_2$, which is common for bearing 104 and eccentric 95 of eccentric shaft 90.

Figure 10:
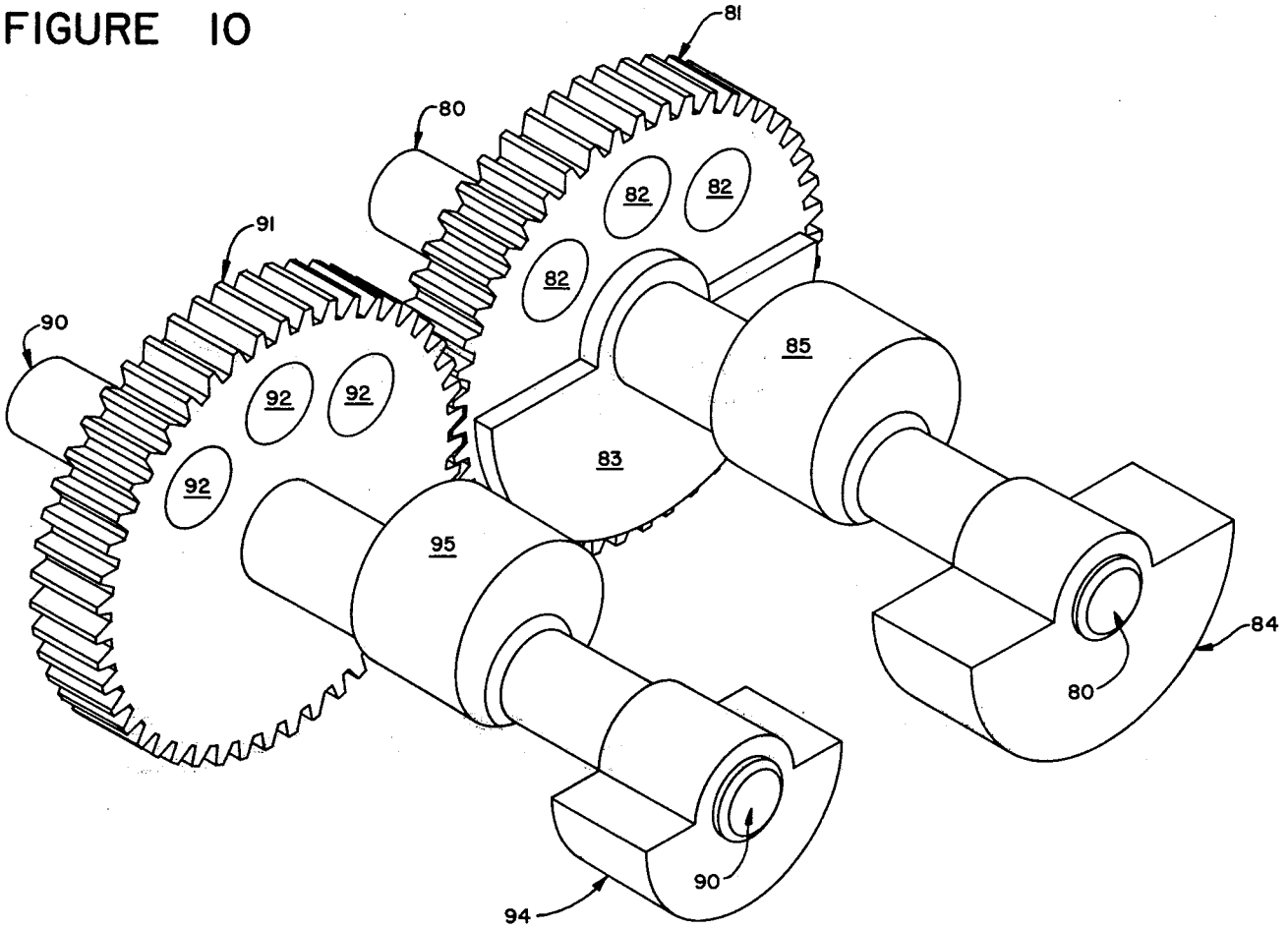
FIG. 10 is a perspective view of the two eccentric shafts with gears and balancing elements.

FIG. 10 shows, in a perspective view from the backside of the engine, eccentric shafts 80 and 90 assembled with their gears and balancing elements. Shafts 80 and 90 are journaled in bearings located in passageways 41, 42, 61, 72, 76 and 77 located in stationary chamber walls 30 and 50 and in gear cover 24, respectively. Eccentric shafts 80 and 90 are furthermore sealed in all of their bearings in order to maintain necessary pressures inside precompression chamber 240 and prevent the leakage of the oil from gear transmission cavity 23. In the last instance, sealed bearings are mounted in the openings 76 and 77 located in the gear transmission cover 24. Bearings mounted in cylinder-piston element 150 and piston element 100 and rotatably assembled on the eccentrics 85 and 95 of the eccentric shafts are not sealed and are being lubricated during the engine operation by a fuel-oil-air mixture in a manner commonly used for lubrication in two stroke reciprocating piston engines. Bearings mounted in the openings in the stationary, flat chamber walls 30 and 50 are lubricated also by a fresh fuel-oil-air charge. Gears 81 and 91 are keyed, or otherwise fixed on their eccentric shafts 80 and 90, respectively, and are coordinating their rotary opposite movements. Gear 81 has some material removed at 82; opposite part of gear 81 is heavier and together with balancing elements 83 in front and balancing element 84 in back of the engine balance eccentric 85 and cylinder-piston 150 rotatably mounted on eccentric 85. Gear 91 has some material removed at 92; opposite part of gear 91 is heavier and acts as a balance and with balancing element 94 balance eccentric 95 and piston 100 rotatably assembled on eccentric 95. All balancing elements 83, 84 and 94 are keyed, or otherwise fixed on their eccentric shafts. It will be understood that balancing elements 83 can be made as integral part of gear 81. Both gears 81 and 91 can be made this way; for instance, both gears can be cast with their balancing means and later machined.

Figure 11:
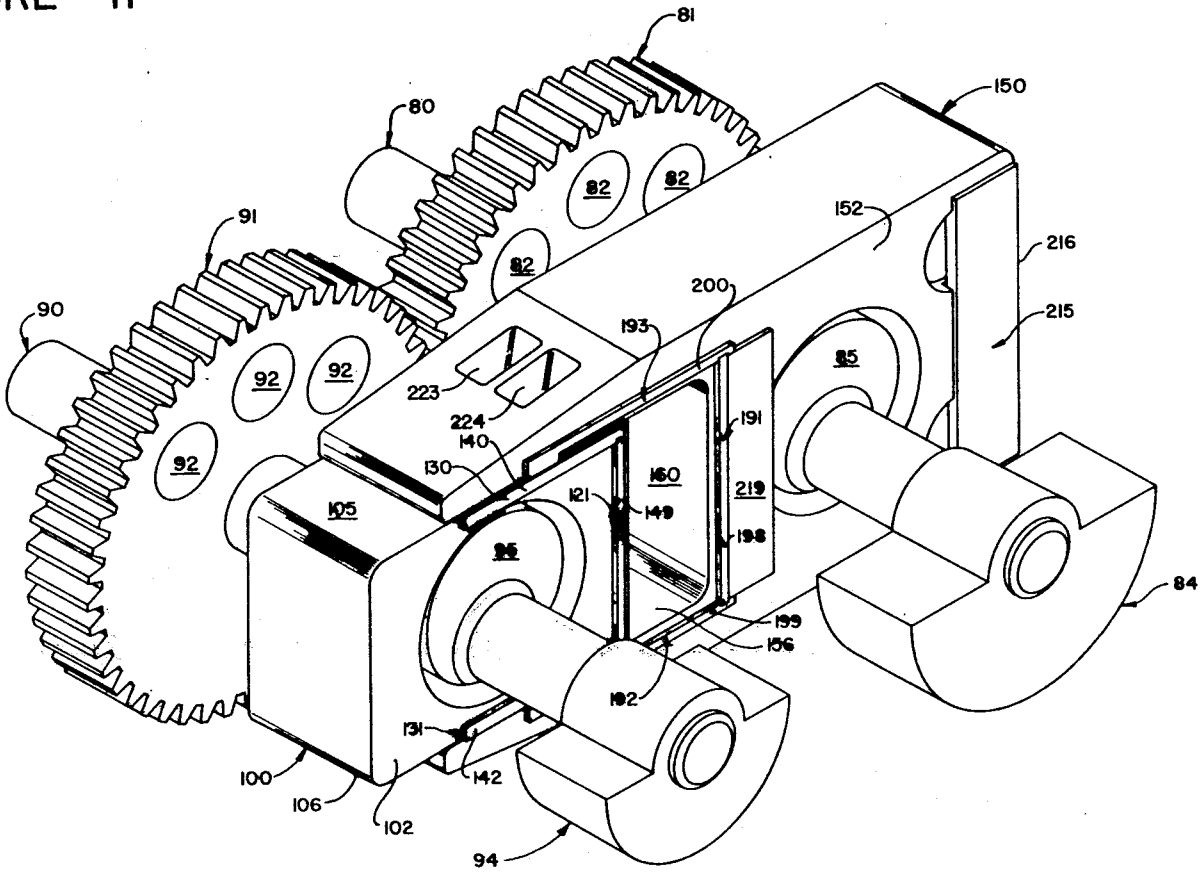
FIG. 11 is a perspective view of the eccentric shafts with all moveable elements of engine.

FIG. 11 shows, in a perspective view, from the backside of the engine, eccentric shafts assembled with gears, balancing elements and with piston and cylinder-piston elements located on their eccentrics. Piston 100 is inserted between arms 154 and 155 of cylinder-piston 150. Flat side 105 of piston 100 adjoins flat surface 157 of arm 155; flat side, or bottom 106 of piston 100 adjoins flat surface 156 of arm 154. Seals 122, 128 and 130 are pressed by their springs against flat surface 157 of arm 155. Surfaces 141 and 144 of seals 130 and 128 are also pressed against surfaces 202 and 187 of sealing elements 193 and 178 located in arm 155 of cylinder-piston 150. Seals 123, 129 and 131 are pressed by their springs against flat surface 156 of arm 154. Surfaces 143 and 147 of seals 131 and 129 are also pressed against surfaces 201 and 186 of sealing elements 192 and 177 located in arm 154 of cylinder-piston 150. All seals 122, 123, 128, 129, 130 and 131 are constantly sliding on flat surfaces 156 and 157 during operation of the engine. To prevent excessive wear, surfaces 156 and 157 must be sufficiently hard. Desired hardness might be obtained by using sufficiently hard material for arms 154 and 155 or by hard coating of surfaces 156 and 157, when cylinder-piston 150 is made of soft alloy.

When fully assembled, sides 183, 184 and 185 of sealing strips 176, 177 and 178 of cylinder-piston 150 and sides 148, 145 and 146 of sealing strips 120, 128 and 129 of piston 100 are pushed by their springs against flat side 31 of front stationary wall 30. On the side 152 of cylinder-piston 150 and on side 102 of piston 100 elements, sides 198, 199, 200, 149, 140 and 142 of sealing strips 191, 192, 193, 121, 130 and 131 are pushed by their springs against flat side 51 of the back stationary wall 50. Also, sealing plates 208 and 212 are pushed against flat side 31, and plates 215 and 219 are forced by their springs against flat side 51. All the above mentioned sealing elements are constantly sliding on flat sides 31 and 51 during operation of the engine. To prevent excessive wear of said sides 31 and 51, their surfaces must be sufficiently hard. Desired hardness might be obtained by hard coating of surfaces 31 and 51 when walls 30 and 50 are made of soft alloy, or by using suitable hard material for walls 30 and 50.

All sealing elements, located in grooves of cylinder-piston 150 and piston 100 elements may be cast iron, steel, or any suitable material. Lubrication of all coacting moveable elements is accomplished by using a fuel charge mixed with lubricant. This lubricant passes over all of the moveable surfaces of the engine itself. The gear transmission and the bearing in front cover 24 are lubricated by separate lubricant in cavity 23.

As the internal combustion two stoke rotary engine operates, cylinder-piston element 150 and piston element 100 rotate in their planetary rotations resulting in constantly changing volumes of combustion chamber 230 and precompression chamber 240. Four representative positions of cylinder-piston 150 and piston 100 elements will be now described in connection with FIGS. 12, 13, 14 and 15.

FIG. 12 shows axis $y_1$—$y_1$ of eccentric 85 of eccentric shaft 80 with cylinder-piston element 150 and axis $y_2$—$y_2$ of eccentric 95 of eccentric shaft 90 with piston element 100 positioned interiorly in cavity 22 of engine body 21 and laterally to the position of axes $x_1$—$x_1$ and $x_2$—$x_2$ of eccentric shafts 80 and 90. This position represents the end of the compression stroke in combustion chamber 230, which has reached its minimum volume, and the beginning of the power stroke after the compressed air-fuel charge is ignited by a spark plug 249. Exhaust ports 38 and 58, invisible in the view of this figure, are closed by plates 212 and 219 of cylinder-piston element 150 and intake ports 221, 222, 223 and 224 are closed by sides 105 and 106 of piston element 100. Intake ports 34 and 54 are open connecting intake channels 33 and 53 with precompression chamber 240, which has reached its maximum volume, and fresh air-fuel charge is being drawn into the precompression chamber. The flow of fresh air-fuel charge into the precompression chamber is indicated by open arrows.

During operation of the engine, eccentric shafts 80 and 90 continue their opposite and coordinated gyratory movements, eccentric shaft 80 counterclockwise and eccentric shaft 90 clockwise, until the eccentric shafts, the cylinder-piston and piston elements reach positions shown in the view of FIG. 13.

FIG. 13 shows axis $y_1$—$y_1$ of eccentric 85 of eccentric shaft 80 with cylinder-piston element 150 and axis $y_2$—$y_2$ of eccentric 95 of eccentric shaft 90 with piston element 100 positioned upwardly in cavity 22 of engine body 21 and upwardly to the position of axes $x_1$—$x_1$ and $x_2$—$x_2$ of eccentric shafts 80 and 90. Cylinder-piston element 150 was moved up and to the left and piston element 100 was moved up and to the right from the positions shown in FIG. 12. During these movements, the volume of combustion chamber 230 constantly increased and the volume of precompression chamber 240 constantly decreased. The position, as shown in the view of FIG. 13, represents the middle of the power stroke in combustion chamber 230. Exhaust ports 38 and 58 are closed by plates 212 and 219 of cylinder-piston element 150 and intake ports 221, 222, 223 and 224 are closed by sides 105 and 106 of piston element 100. Intake ports 34 and 54, connecting intake channels 33 and 53 with precompression chamber 240 are also closed by plates 208 and 215 of cylinder-piston element 150 and the fresh air-fuel charge, drawn into precompression chamber 240 when ports 34 and 54 were open, is compressed as the volume of the precompression chamber 240 decreases.

As the rotary two stroke internal combustion engine continues its operation, the moving components will reach the position shown in the view of FIG. 14. FIG. 14 shows axis $y_1$—$y_1$ of eccentric 85 of eccentric shaft 80 with cylinder-piston element 150 and axis $y_2$—$y_2$ of eccentric 95 of eccentric shaft 90 with piston element 100 positioned exteriorly in cavity 22 of engine body 21 and laterally to the position of axes $x_1$—$x_1$ and $x_2$—$x_2$ of eccentric shafts 80 and 90. Cylinder-piston element 150 was moved down and to the left and piston element 100 was moved down and to the right between the views of FIGS. 13 and 14. During this move, volume of combustion chamber 230 constantly increased and reached its maximum, and volume of precompression chamber 240 constantly decreased and reached its minimum. This position, as shown in the view of FIG. 14, represents the cylinder-piston and piston elements in the middle of the exhaust stroke and in the middle of the intake of the precompressed charge from precompression chamber 240 into combustion chamber 230. Exhaust ports 38 and 58 are opened and spent products of combustion are escaping into said ports 38 and 58 and into exhaust channels 33 and 53, as it is indicated by dotted arrows. The intake ports 221, 222, 223 and 224, located in spaced arms 154 and 155 of cylinder-piston element 150, were opened slightly later than exhaust ports 38 and 58 and precompressed air-fuel charge is transferred from precompression chamber 240 into combustion chamber 230.

As the engine continues its operation, cylinder-piston element 150 and piston element 100 will rotate, will close intake ports 221, 222, 223 and 224 and exhaust ports 38 and 58 will reach the position shown in the view of the FIG. 15. FIG. 15 shows axis $y_1$—$y_1$ of eccentric 85 of eccentric shaft 80 with cylinder-piston element 150 and axis $y_2$—$y_2$ of eccentric 95 of eccentric shaft 90 with piston element 100 positioned downwardly in cavity 22 of engine body 21 and downwardly to the position of the axes $x_1$—$x_1$ and $x_2$—$x_2$ of eccentric shafts 80 and 90. Therefore, cylinder-piston element 150 was moved down and to the right and piston element 100 was moved down and to the left between the views of FIGS. 14 and 15. During this move, volume of combustion chamber 230 decreased and volume of precompression chamber 240 increased. In the position of the cylinder-piston and piston elements, as shown in the view of FIG. 15, all intake and exhaust ports are closed by cylinder-piston element 150 and sealing plates and by piston element 100. The fresh air-fuel charge, drawn into combustion chamber 230 during the intake stroke is being compressed in said combustion chamber as volume of the chamber decreases. At the same time, volume of precompression chamber 240 increases and underpressure, or partial vacuum is being built in precompression chamber 240. The underpressure, or vacuum will draw fresh air-fuel charge into precompression chamber 240 when cylinder-piston element 150 and piston element 100 will reach the position shown in the view of FIG. 12 and when intake ports 34 and 54 connecting intake channels 33 and 53 with precompression chamber 240 will be open.

The description of the operation of the invention will be completed by describing the changes in the internal combustion rotary two stroke engine between the positions shown in the views of FIGS. 15 and 12. During the move of cylinder-piston 150 and piston 100 elements, as shown in the views of FIGS. 15 and 12, cylinder-piston element 150 moves up and to the right and piston element 100 moves up and to the left. The volume of the combustion chamber will decrease and combustion chamber 230 will reach its minimum volume. Fresh air-fuel charge is fully compressed and prepared for ignition. At this time, the volume of precompression chamber 240 reaches its maximum and the fresh air-fuel charge will be drawn into this chamber when intake ports 34 and 54 are opened by edges 209 and 216 of the cylinder-piston element 150 pleates 208 and 215. At this point, one full cycle of the operation of the internal combustion two stroke rotary engine is completed and the engine will be fully prepared to start next such cycle.

It is understood that the intake channels 33 and 53 at the ends opposite to intake ports 34 and 54 are connected to an appropriate source of incoming fresh charge. The fresh charge may be air-fuel-oil charge for a two stroke internal combustion rotary engine or any suitable charge for the operation of the mechanism, such as air charge for Diesel rotary engine, or any desired fluid when the mechanism is used as a pump or compressor.

When the rotary mechanism of this invention is used as a pump, compressor or non-supercharged internal combustion engine, it is naturally aspirated. It also can be used as a supercharged two stroke internal combustion engine by having an external supercharger.

The rotary mechanism of this invention may be constructed of any suitable materials and operate on any suitable fuels known to the art.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A two-stroke mechanism with rotary cylinder-piston and piston movements comprising:

a U-shaped cylinder-piston element having polyhedral body and spaced, parallel arms with parallel, flat opposing surfaces, means for rotatable mounting to an eccentric shaft and means for balancing said cylinder-piston element;

a polyhedral piston element having spaced, parallel sides adjoining said cylinder-piston flat, opposing surfaces of said spaced, parallel arms and means for rotatable mounting to a second eccentric shaft;

said cylinder-piston and piston elements forming movable walls of two variable volume chambers;

two axially spaced, stationary parallel walls adjoining opposite sides of said piston and cylinder-piston elements forming stationary walls of said first variable volume chamber;

sealing means on said cylinder-piston and said piston elements sealing said first variable volume chamber;

a peripheral wall interconnecting said spaced, stationary parallel walls to form with said spaced, stationary parallel walls the stationary walls of a second variable volume chamber;

a rotatable cylinder-piston eccentric shaft mounted in said cylinder-piston element and in said spaced, stationary parallel walls;

balancing means, balancing said cylinder-piston eccentric shaft;

a rotatable piston eccentric shaft mounted in said piston element and in said spaced, stationary parallel walls;

balancing means, balancing said piston eccentric shaft;

gearing means interconnecting said eccentric shafts so said eccentric shafts and their cylinder-piston and piston elements follow opposite and coordinated rotary paths within said second variable volume chamber;

intake means in said spaced parallel walls and in said cylinder-piston element and discharge means in said spaced parallel walls;

cooling means for cooling said spaced, parallel stationary walls and said piston and cylinder-piston elements;

lubricating means for lubricating coacting surfaces; and lubricating means for lubricating said gearing means.

2. The mechanism of claim 1 wherein said mechanism is an internal combustion prime mover.

3. The internal combustion prime mover of claim 2 wherein said first variable volume chamber is a combustion chamber and second variable volume chamber is a precompression chamber.

4. An internal combustion prime mover of claim 3 wherein said prime mover is spark fired.

5. An internal combustion prime mover of claim 3 wherein said prime mover is a compression ignition prime mover.

6. The mechanism of claim 1 wherein said mechanism is a compressor.

7. The mechanism of claim 1 wherein said mechanism is an external combustion engine and said first variable volume chamber is an expansion chamber.

8. The mechanism of claim 1 wherein said means for rotatable mounting of said cylinder-piston element to an eccentric shaft comprises a bearing mounted in a passageway in said polyhedral body of said cylinder-piston element.

9. The mechanism of claim 1 wherein said balancing means of said cylinder-piston element comprises balancing elements located in a part of said polyhedral body remote from the said spaced, parallel arms making the center of gravity of said cylinder-piston element located on or close to the axis of said bearing, mounted in said cylinder-piston element.

10. The mechanism of claim 1 wherein said means for rotatable mounting of piston element on said piston eccentric shaft comprises a bearing mounted in a passageway in said polyhedral piston element.

11. The mechanism of claim 10 wherein said polyhedral piston element is balanced and has its center of gravity on or close to the axis of said piston bearing.

12. The mechanism of claim 1 wherein said axially spaced, stationary walls have flat surfaces adjoining said opposite sides of said piston and cylinder-piston elements.

13. The mechanism of claim 12 wherein said flat surfaces of said axially spaced, stationary parallel walls are sufficiently hard for long lasting operation.

14. The mechanism of claim 13 wherein said axially spaced, stationary parallel walls are built of hard material.

15. The mechanism of claim 13 wherein said flat surfaces of said axially spaced, stationary walls are hard coated.

16. The rotary mechanism of claim 1 wherein said parallel, flat opposing surfaces of said spaced, parallel arms of said U-shaped cylinder-piston element, coacting with said spaced, parallel sides of said piston element are sufficiently hard for long lasting operation.

17. The mechanism of claim 16 wherein said spaced parallel arms of said U-shaped cylinder-piston element are made of hard material.

18. The mechanism of claim 16 wherein said spaced, parallel arms are built of soft material and have hard coated said parallel, flat opposing surfaces.

19. The mechanism of claim 1 wherein each eccentric shaft has an eccentric portion, said eccentric portion of each eccentric shaft moving the respective cylinder-piston and piston elements in opposed rotary motions around the axes of said eccentric shafts.

20. The mechanism of claim 19 wherein one of said eccentric shafts operates as a drive shaft for a work output.

21. The mechanism of claim 19 wherein both of said eccentric shafts operate as drive shafts for a work output.

22. The mechanism of claim 19 wherein each said eccentric shaft is journaled in bearings located in each of said axially spaced, stationary, parallel walls.

23. The mechanism of claim 22 wherein said balancing means of said cylinder-piston eccentric shaft include balancing elements rigidly mounted on both sides of said eccentric portion making the center of gravity of said cylinder-piston eccentric shaft with said cylinder-piston element located on or close to the axis of said cylinder-piston eccentric shaft.

24. The mechanism of claim 22 wherein said balancing means of said piston eccentric shaft including balancing elements rigidly mounted on both sides of said eccentric portion and making the center of gravity of said piston eccentric shaft with its piston element located on or close to the axis of said piston eccentric shaft.

25. The mechanism of claim 1 wherein said gearing means is used for balancing.

26. The mechanism of claim 1 wherein said sealing means on said cylinder-piston element comprises a set of three grooves with spring loaded sealing elements located in said grooves, said grooves being located on each of said opposite side of said cylinder-piston element and alongside the edges of said movable walls of said first variable volume chamber.

27. The mechanism of claim 26 in which said seals are pushed by said springs against said flat, hard surfaces of said axially spaced, stationary, parallel walls.

28. The mechanism of claim 27 in which each of the sealing elements have an interlocking connection with adjacent sealing elements to maintain an uninterrupted seal.

29. The mechanism of claim 28 in which grooves located alongside and in the said spaced, parallel arms have apertures in their ends outwardly from said polyhedral part of said cylinder-piston element and in which sealing elements, located in said grooves have flange portions corresponding in shape and size to said apertures, and in which one of the surfaces of said flange portion is in the same plane, when said seals are inserted in their grooves, with said parallel, flat opposing surfaces of said spaced, parallel arms.

30. The mechanism of claim 1 wherein said piston element sealing means comprises a set of eight grooves, and eight spring loaded sealing strips, located alongside the four edges of the movable wall of said first variable volume chamber and alongside the corners made by walls normal to said movable wall in which each of the sealing elements have an interlocking connection with adjacent sealing elements to maintain a closed seal.

31. The mechanism of claim 30 in which said sealing elements are pushed by their springs against the said flat sides of said axially spaced, stationary flat walls and against said flat, opposing surfaces of said spaced, parallel arms of said cylinder-piston element and against said surfaces of said flange portions of said sealing strips of said cylinder-piston element to form a closed sealing system, sealing the said first variable volume chamber.

32. The mechanism of claim 1 wherein said sealing means of said first variable volume chamber are made of materials selected from the group of cast iron, steel and ferrous based materials.

33. The mechanism of claim 1 in which said cylinder-piston element comprises in said opposite sides recesses with spring loaded plates, sealing intake and exhaust ports of said axially spaced, stationary walls during the operation of the engine.

34. The mechanism of claim 1 in which said intake means comprise intake channels and ports located in said axially spaced stationary walls and connecting the source of suitable charge with said second variable volume chamber, said intake ports being sequentially opened and closed during the operation of the engine by said plates, sealing said intake ports and located in the said opposite sides of said cylinder-piston element.

35. The mechanism of claim 1 wherein said intake means comprises transfer ports, located in said spaced, parallel arms of said cylinder-piston element and connecting the said first variable volume chamber with said second variable volume chamber and are opened and closed sequentially during the operation of the mechanism by said piston element.

36. The mechanism of claim 1 wherein said discharge means comprises exhaust channels and ports, located in said axially spaced stationary walls, connecting said first variable volume chamber with outside of the said rotary mechanism and said exhaust ports being sequentially opened and closed during the operation of the said two-stroke mechanism by said cylinder-piston element.

37. The mechanism of claim 1 wherein said cooling means comprises cooling chambers, located in said axially spaced, stationary walls and connected to a source of cooling medium.

38. The mechanism of claim 1 wherein said cooling means include cooling of said cylinder-piston and piston elements by fresh charge incoming into said second variable volume chamber.

39. The mechanism of claim 1 wherein sealing of said second variable volume chamber is obtained by sealing elements located between coacting walls of said axially spaced, stationary walls and said peripheral wall, and by sealing eccentric shafts in their bearings located in said axially spaced, stationary walls.

40. The mechanism of claim 1 wherein said gearing means interconnecting said eccentric shafts are covered by a cover, and within said cover is provided oil bath for lubricating said gearing means.

41. The mechanism of claim 1 wherein said shafts balancing elements have separate cover.

42. The mechanism of claim 1 wherein said axially spaced, stationary walls, said peripheral wall, said gearing means cover and said shafts balancing elements cover have a plurality of openings with bolts securing together all of the above said elements.

* * * * *